US008622754B2

(12) United States Patent
Delgado et al.

(10) Patent No.: US 8,622,754 B2
(45) Date of Patent: Jan. 7, 2014

(54) FLEXIBLE POWER CONNECTOR

(75) Inventors: Eladio Clemente Delgado, Burnt Hills, NY (US); Richard Alfred Beaupre, Pittsfield, MA (US); Brian Lynn Rowden, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 227 days.

(21) Appl. No.: 13/194,953

(22) Filed: Jul. 31, 2011

(65) Prior Publication Data

US 2013/0029531 A1 Jan. 31, 2013

(51) Int. Cl.
*H01R 12/00* (2006.01)

(52) U.S. Cl.
USPC ..... 439/68

(58) Field of Classification Search
USPC ..... 439/626, 68–71; 257/701, 690–691; 361/699, 704, 706, 788
See application file for complete search history.

(56) References Cited

U.S. PATENT DOCUMENTS

| | | | | |
|---|---|---|---|---|
| 5,424,579 | A * | 6/1995 | Arai et al. | 257/690 |
| 5,574,312 | A * | 11/1996 | Bayerer et al. | 257/706 |
| 5,748,451 | A * | 5/1998 | Thompson et al. | 361/788 |
| 6,266,227 | B1 * | 7/2001 | Konushi et al. | 361/306.1 |
| 6,359,331 | B1 * | 3/2002 | Rinehart et al. | 257/691 |
| 6,377,461 | B1 * | 4/2002 | Ozmat et al. | 361/704 |
| 6,381,161 | B2 * | 4/2002 | Mourick | 363/147 |
| 6,584,681 | B2 * | 7/2003 | Lorenz et al. | 29/830 |
| 7,204,648 | B2 | 4/2007 | Aronson | |
| 7,327,024 | B2 | 2/2008 | Stevanovic et al. | |
| 7,817,422 | B2 * | 10/2010 | Gunturi et al. | 361/699 |
| 8,208,260 | B2 * | 6/2012 | Okumura et al. | 361/715 |
| 8,218,320 | B2 * | 7/2012 | Pautsch et al. | 361/699 |
| 8,358,000 | B2 * | 1/2013 | Beaupre et al. | 257/691 |
| 2004/0041253 | A1 * | 3/2004 | Yamada et al. | 257/701 |

FOREIGN PATENT DOCUMENTS

| | | | |
|---|---|---|---|
| JP | 2006270064 | A | 10/2006 |
| JP | 2010073359 | A | 4/2010 |
| KR | 100652728 | B1 | 11/2006 |

OTHER PUBLICATIONS

Jie Chang et al.,"High-Frequency AC-AC Converter Using 3-In-1 IBPMs and Adaptive Commutation", 30th Annual IEEE Power Electronics Specialists Conference, pp. 351-357, vol. 1, Aug. 1999.

* cited by examiner

*Primary Examiner* — Jean F Duverne
(74) *Attorney, Agent, or Firm* — Seema S. Katragadda

(57) ABSTRACT

A flexible power connector is presented. An embodiment of a flexible power connector includes a stacked structure having one or more insulating strips alternatingly arranged with a plurality of conducting strips, wherein the one or more insulating strips are interposed between the plurality of conducting strips to insulate each conducting strip from the other conducting strip in the stacked structure, and wherein the plurality of conducting strips is disposed parallel and proximate to each other to reduce electrical losses in the stacked structure

18 Claims, 6 Drawing Sheets

FLEXIBLE POWER CONNECTOR

BACKGROUND

The disclosure relates generally to a power electronics system and more specifically to a flexible power connector for effecting a power connection between power conducting units.

Transmission of power through an electric circuit results in energy losses such as conductive losses and inductive losses. Conductive losses typically include heat loss that is mainly due to the resistance of conductors and electrical connectors between the conductors. Similarly, inductive losses may be due to a change in the voltage and the inductance of the circuit. Moreover, the inductive losses may be proportional to a frequency of the voltage change and the inductance of the circuit. The inductance of the circuit may be influenced by the geometry of the circuit itself or by the geometry of the electrical connector.

The nature of power transmitted through electric circuits is continuously changing. For example, in switched circuits, the speed at which the voltage may change is constantly increasing with the onset of more advanced high switching speed semiconductors. Consequently, inductive losses are proportional to the speed of the voltage change and are related to the geometry of the circuit. Accordingly, increased attention must be paid to the geometry of electrical connectors in order to minimize inductive losses.

In the high power electronics industry, conventional power connectors are rarely designed to support advanced high switching speed semiconductors. Typically, the conventional power connectors are designed with two mating components, such as a male component and a female component. Generally, the male component is a two pole male component. Further, when this two pole male component mates with the female component, the female component has inherent wide gaps between the poles of the male component. These inherent wide gaps further result in inductive losses, such as parasitic inductance and conductive losses and contact resistance losses in the power connector. Particularly, these losses are very high when it is desirable for the power connector to handle a current in the range of hundreds of amperes and a switching frequency in a range of hundreds of kilohertz. In addition, since the power connectors include two mating components and especially, the male component is an expensive two-pole component, there is a substantial increase in the cost and complexity of the power connectors.

It is therefore desirable to develop a design of a power connector that reduces electrical losses in the power electronics system. Particularly, it is desirable to develop a low cost, rugged, and cost effective single component connector having low inductive and conductive losses.

BRIEF DESCRIPTION

Briefly in accordance with one aspect of the technique, a flexible power connector is presented. The flexible power connector includes a stacked structure having one or more insulating strips alternatingly arranged with a plurality of conducting strips, wherein the one or more insulating strips are interposed between the plurality of conducting strips to insulate each conducting strip from the other conducting strip in the stacked structure, and wherein the plurality of conducting strips is disposed parallel and proximate to each other to reduce electrical losses in the stacked structure.

In accordance with a further aspect of the present technique, a method for forming a power connector is presented.

The method includes alternatingly disposing one or more insulating strips between a plurality of conducting strips to form a stacked structure, wherein the plurality of conducting strips are disposed parallel and proximate to each other. The method further includes disposing at least one peripheral insulating layer on a portion of the stacked structure such that a first portion of the stacked structure at a first end of the stacked structure having the conducting strips and the insulating strips protrude beyond the at least one peripheral layer and a second portion of the stacked structure at a second end of the stacked structure having the conducting strips and the insulating strips protrude beyond the at least one peripheral layer.

In accordance with another aspect of the present technique, a system is presented. The system includes one or more flexible power connectors, wherein each of the one or more flexible power connectors includes a stacked structure having one or more insulating strips alternatingly arranged with a plurality of conducting strips, wherein the one or more insulating strips are interposed between the plurality of conducting strips to insulate each conducting strip from the other conducting strip in the stacked structure, and wherein the plurality of conducting strips is disposed parallel and proximate to each other. The one or more flexible power connectors further includes at least one peripheral insulating layer disposed on a portion of the stacked structure such that at least a portion of the stacked structure protrudes beyond the at least one peripheral layer at the first end and the second end of the stacked structure, wherein the at least one peripheral layer is configured to insulate the stacked conducting layers from at least one external conducting material. The system also includes a first conducting unit coupled to a first end of the one or more flexible power connectors, and a second conducting unit coupled to a second end of the one or more flexible power connectors.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As will be described in detail hereinafter, various embodiments of an exemplary power connector for use in a power electronics system and method for forming the power connector are presented. By employing the power connector and the method for forming the power connector described hereinafter, electrical losses such as inductive losses and/or contact resistive losses may be substantially reduced in the power electronics system. In addition, the exemplary power connector is a low cost, rugged, and cost effective single component connector that is configured to withstand external vibrations in the power electronics system.

Figure 1:
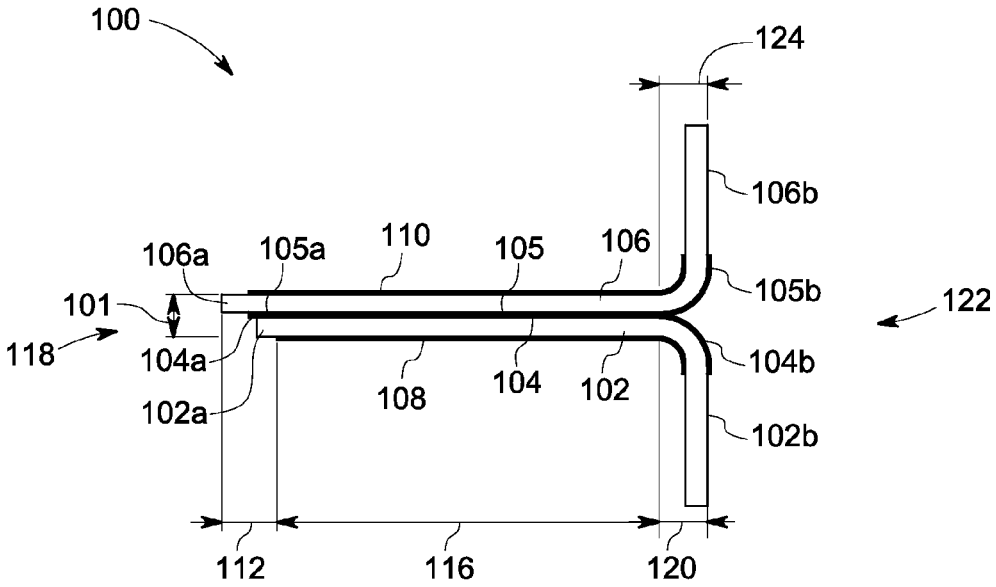
FIG. 1 is a cross-sectional side view of a power connector, in accordance with aspects of the present technique.

Turning now to the drawings, and referring to FIG. 1, a cross-sectional side view of a power connector 100, in accordance with aspects of the present technique, is depicted. The connector 100 includes a composite stacked structure 101 that is formed by arranging a plurality of layers as depicted in FIG. 1. Particularly, the composite stacked structure 101 includes alternating layers of conducting strips and insulating strips. More specifically, the composite stacked structure 101 includes an arrangement where one or more layers of insulating strips are alternatingly arranged with a plurality of layers of conducting strips. In one embodiment, a single insulating layer may be disposed or sandwiched between two consecutive conducting strips. Moreover, in certain embodiments, the single insulating layer may include two or more insulating strips, as depicted in FIG. 1. However, in certain other embodiments, only one insulating strip may be sandwiched between two consecutive conducting strips. In the embodiment depicted in FIG. 1, the insulating layer includes two insulating strips.

In the example depicted in FIG. 1, the composite stacked structure 101 is depicted as including a first conducting strip 102 and a second conducting strip 106 that are alternatingly stacked with a pair of insulating strips such as the first insulating strip 104 and the second insulating strip 105. It may be noted that, in one embodiment, the first insulating strip 104 and the second insulating strip 105 may be coupled to each other to form a single insulating layer and this single insulating layer may be sandwiched between the conducting strips 102, 106. By way of example, the first insulating strip 104 may be glued to the second insulating strip 105 to form the single insulating layer. These strips 102, 104, 105, 106 are substantially planar strips that are disposed parallel and proximate to each other, in certain embodiments. Particularly, in the stacked structure 101, the conducting strips 102, 106 are disposed in close proximity to each other with a pair of relatively thin insulators, such as the insulating strips 104, 105 disposed between the two conducting strips 102, 106. As previously noted, in one embodiment, only one insulator, such as the insulating strip 104 may be sandwiched between the conducting strips 102, 106. Also in certain embodiments, the strips 102, 104, 105, 106 are flexible. This flexibility of the strips allows the connector 100 to be manipulated into any desired shape or structure. It may be noted that there may be any number of conducting strips and insulating strips in the stacked structure 101 and is not limited to the number of strips shown in FIG. 1.

Furthermore, in accordance with exemplary aspects of the present technique, the insulating strips 104, 105 are interposed between the first conducting strip 102 and the second conducting strip 106 to insulate the first conducting strip 102 from the second conducting strip 106. As previously noted, the insulating layer between the first conducting strip 102 and the second conducting strip 106 is not limited to two insulating strips 104, 105. Accordingly, there may be any number of insulating strips interposed between the first conducting strip 102 and the second conducting strip 106. The insulating strips 104, 105 may be formed using any insulating material having a thickness in a range from about 0.5 mil to about 10 mil. In one embodiment, the insulating strips 104, 105 may be a polyimide film with a thickness of about 1 mil Moreover, in one embodiment, the first conducting strip 102 and the second conducting strip 106 are stiff bars that are formed using high strength and high conductivity material, such as, but not limited to, beryllium copper, phosphor bronze, and/or silicon bronze. These stiffening bars are planar in structure and may have a thickness in a range from about 10 mil to about 60 mil As will be appreciated, in a conventional power connector, there is an inherent wide air gap between the mating conducting components. This inherent wide air gap increases the inductive loop/path in the connector, which results in very large parasitic inductance in the connector. These shortcomings of the currently available connectors may be circumvented via use of the exemplary connector 100. Particularly, in accordance with aspects of the present technique, the first conducting strip 102 and the second conducting strip 106 are disposed parallel and proximate to each other. Disposing the two conducting strips 102, 106 proximate to one another advantageously reduces the separation between the two conducting strips 102, 106. For example, the two conducting strips 102, 106 may be separated by a distance in a range from about 0.5 mil to about 10 mil. By reducing the separation between the two conducting strips 102, 106, the inductive loop/path in the connector 100 is minimized, which in turn reduces inductive losses, such as parasitic inductance in the connector 100.

Additionally, the connector 100 includes at least one peripheral insulating layer that is disposed on at least a portion of the stacked structure 101. The at least one peripheral insulating layer is configured to insulate the connector 100 from other conducting surfaces. It may be noted that the terms peripheral insulating layer and peripheral layer may be used interchangeably. In the embodiment of FIG. 1, the connector 100 includes a first peripheral layer 108 and a second peripheral layer 110. The first peripheral layer 108 is disposed on a portion of a bottom surface of the stacked structure 101, while a second peripheral layer 110 is disposed on a portion of a top surface of the stacked structure 101. The first peripheral layer 108 is disposed on an outer surface of the first conducting strip 102, as shown in FIG. 1, to insulate the first conducting strip 102 from external conducting surfaces and/or materials. Similarly, the second peripheral layer 110 is disposed on an outer surface of the second conducting strip 106, as shown in FIG. 1, to insulate the second conducting strip 106 from external conducting surfaces and/or materials.

In a presently contemplated configuration, reference numeral 118 is generally representative of a first end of the stacked structure 101, while a second end of the stacked structure 101 is generally represented by reference numeral 122. In accordance with exemplary aspects of the present technique, the conducting strips 102, 106 protrude beyond a main body 116 of the stacked structure 101. Particularly, a first portion 112 of the stacked structure 101 at the first end 118 protrudes beyond the peripheral insulating layers 108. The protruding portion 112 may be employed to couple the connector 100 to a first conducting unit. As depicted in FIG. 1, the protruding first portion 112 of the stacked structure 101 includes a first set of protruding conducting strips **102*a*, 106*a* and a first set of protruding insulating strips 104*a*, 105*a*. It may be noted that the first set of protruding conducting strips 102*a*, 106*a* are respectively representative of portions of the conducting strips 102, 106 that respectively extend or protrude beyond the peripheral layers 108, 110. In one embodiment, the protruding conducting strip 106*a* is extended beyond the protruding conducting strip 102*a*, as depicted in FIG. 1. In another embodiment, the protruding conducting strip 106***a* may be of same length as the protruding conducting strip 102*a* in the first portion 112 of the stacked structure. Similarly, the first set of protruding insulating strips 104*a*, 105*a* are respectively representative of portions of the insulating strips 104, 105 that extend or protrude beyond the peripheral layer 108. Accordingly, reference numerals 102*a*, 104*a*, 105*a*, 106*a* represent protruded portions of the conducting strips 102, 106 and the insulating strips 104, 105 at the first end 118 of the stacked structure 101.

In a similar manner, a second portion 120 of the stacked structure 101 at the second end 122 protrudes beyond the peripheral insulating layers 108, 110. The protruding second portion 120 may be used to couple the connector 100 to a second conducting unit. As depicted in FIG. 1, the protruding second portion 120 of the stacked structure 101 includes a second set of protruding conducting strips 102*b*, 106*b* and a second set of protruding insulating strips 104*b*, 105*b*. It may be noted that the second set of protruding conducting strips 102*b*, 106*b* are respectively representative of portions of the conducting strips 102, 106 that extend or protrude beyond the peripheral layers 108, 110. Similarly, the second set of protruding insulating strips 104*b*, 105*b* are respectively representative of portions of the insulating strips 104, 105 that extend or protrude at least to a length of the peripheral layers 108, 110 in the second portion 120. In one embodiment, the second set of protruding insulating strips 104*b*, 105*b* may protrude beyond the peripheral layers 108, 110. Accordingly, reference numerals 102*b*, 104*b*, 105*b*, 106*b* represent protruded portions of the conducting strips 102, 106 and the insulating strips 104, 105 at the second end 122 of the stacked structure 101.

Moreover, in accordance with exemplary aspects of the present technique, the second set of protruding conducting strips 102*b*, 106*b* are bent away from each other to form a curved section 124, as depicted in FIG. 1. The curved section 124 of the conducting strips is used to aid in face bolting the connector 100 to the second conducting unit. Similarly, the second set of protruding insulating strips 104*b*, 105*b* are also bent away from one another. Particularly, the second set of protruding insulating strips 104*b*, 105*b* are bent away from one another such that the second set of protruding insulating strips 104*b*, 105*b* conform to the curved sections 124 of the protruding conducting strips 102*b*, 106*b*. The first conducting unit and the second conducting unit will be explained in greater detail with reference to FIG. 3.

Figure 2:
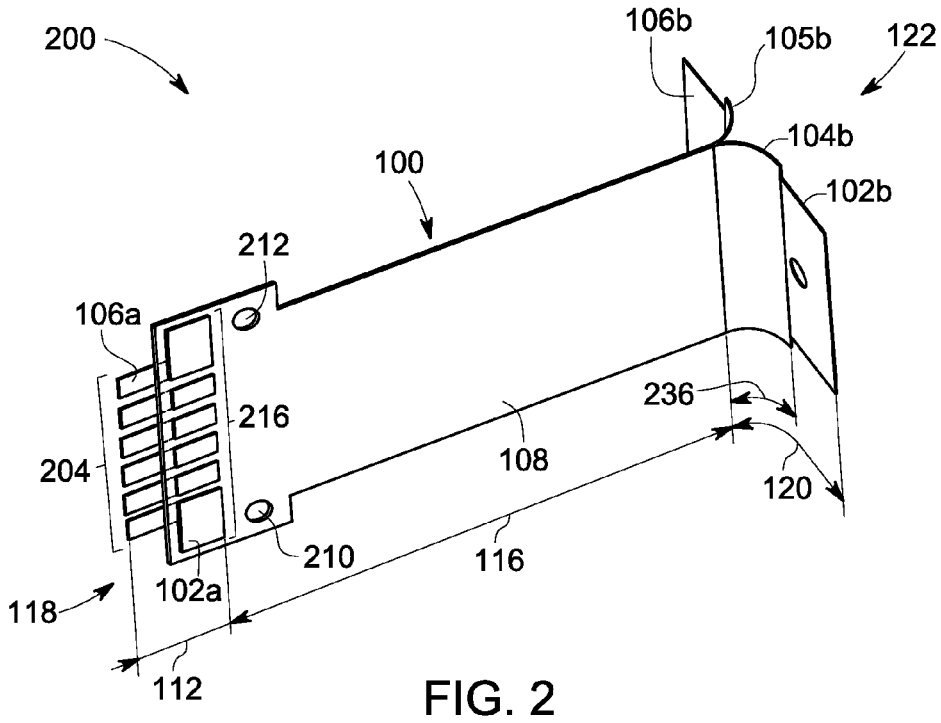
FIG. 2 is a perspective view of the power connector showing a bottom surface and protruding portions of the power connector of FIG. 1, in accordance with aspects of the present technique.

FIG. 2 illustrates a perspective view 200 of the power connector 100 of FIG. 1. Particularly, a bottom surface and protruding portions of the power connector 100 of FIG. 1 are illustrated in FIG. 2. The connector 100 includes the first portion 112 and the second portion 120 of the stacked structure 101 at two opposite ends of the connector 100, as previously noted.

In a presently contemplated configuration, the first portion 112 of the stacked structure 101 includes the first protruding conducting strip 102*a* that is extended beyond the first peripheral layer 108 but, within the protruding insulating strips 104*a*, 105*a* and the second protruding conducting strip 106*a*. Further, a portion of the first protruding conducting strip 102*a* is removed at regular intervals to form a tap structure 216, as depicted in FIG. 2. The tap structure 216 may be employed to operatively couple the connector 100 to the first conducting unit (see FIG. 3). More specifically, the tap structure 216 of the first protruding conducting strip 102*a* is electrically coupled to a substrate of the first conducting unit, in certain embodiments. This coupling reduces the contact resistance between the conducting strip 102 and the first conducting unit.

Furthermore, the first portion 112 of the stacked structure 101 includes the second protruding conducting strip 106*a* that is extended beyond the protruding insulating strips 104*a*, 105*a* and the second peripheral layer 110, as depicted in FIG. 2. Moreover, a portion of the second protruding conducting strip 106*a* is removed at regular intervals to form a tap structure 204, as depicted in FIG. 2. This tap structure 204 may be employed to operatively couple the connector 100 to the first conducting unit (see FIG. 3). By way of example, the second conducting strip 106 may be operatively coupled to the first conducting unit by soldering the tap structure 204 to the first conducting unit.

In a similar manner, the second portion 120 of the stacked structure 101 at the second end 122 that protrudes beyond the peripheral layers 108, 110 includes the second set of protruding conducting strips 102*b*, 106*b* and the second set of protruding insulating strips 104*b*, 105*b*. The second set of protruding conducting strips 102*b* and 106*b* are bent away from each other, as depicted in FIG. 2. This bending away of the strips aids in coupling the second end 122 of the connector 100 to a second conducting unit. By way of example, the "bent" or curved section 124 at the second end 122 of the connector 100 aids in face bolting the connector 100 to the second conducting unit (see FIG. 3). Further, the second set of protruding insulating strips 104*b*, 105*b* are also bent away from each other along with a respective second set of protruding conducting strips 102*b*, 106*b*. Specifically, in one embodiment, the second set of protruding insulating strips 104*b*, 105*b* are bent away from each other such that each protruding insulating strip 104*b*, 105*b* conforms to a corresponding protruding conducting strip 102*b*, 106*b*. For example, the protruding insulating strip 104*b* is bent along with the protruding conducting strip 102*b*, while the protruding insulating strip 105*b* is bent along with the protruding conducting strip 106*b*. Moreover, the second set of protruding insulating strips 104*b*, 105*b* is used to insulate a portion 236 of the second set of protruding conducting strips 102*b*, 106*b* that is not electrically coupled to the second conducting unit.

In a presently contemplated configuration, the connector 100 at the first end 118 includes strain relief apertures 210, 212 that are disposed on opposite sides of the stacked structure 101, as depicted in FIG. 2. The strain relief apertures 210, 212 are configured to aid in coupling the first end 118 of the stacked structure 101 to the first conducting unit. The first end 118 of the stacked structure 101 may be coupled to the first conducting unit by crimping, in one embodiment. Particularly, a screw may be inserted in each of the strain relief apertures 210, 212 to fasten the connector 100 to the first conducting unit. By crimping or fastening the stacked structure 101 to the first conducting unit, the connector 100 may be configured to withstand any external vibrations.

Figure 3:
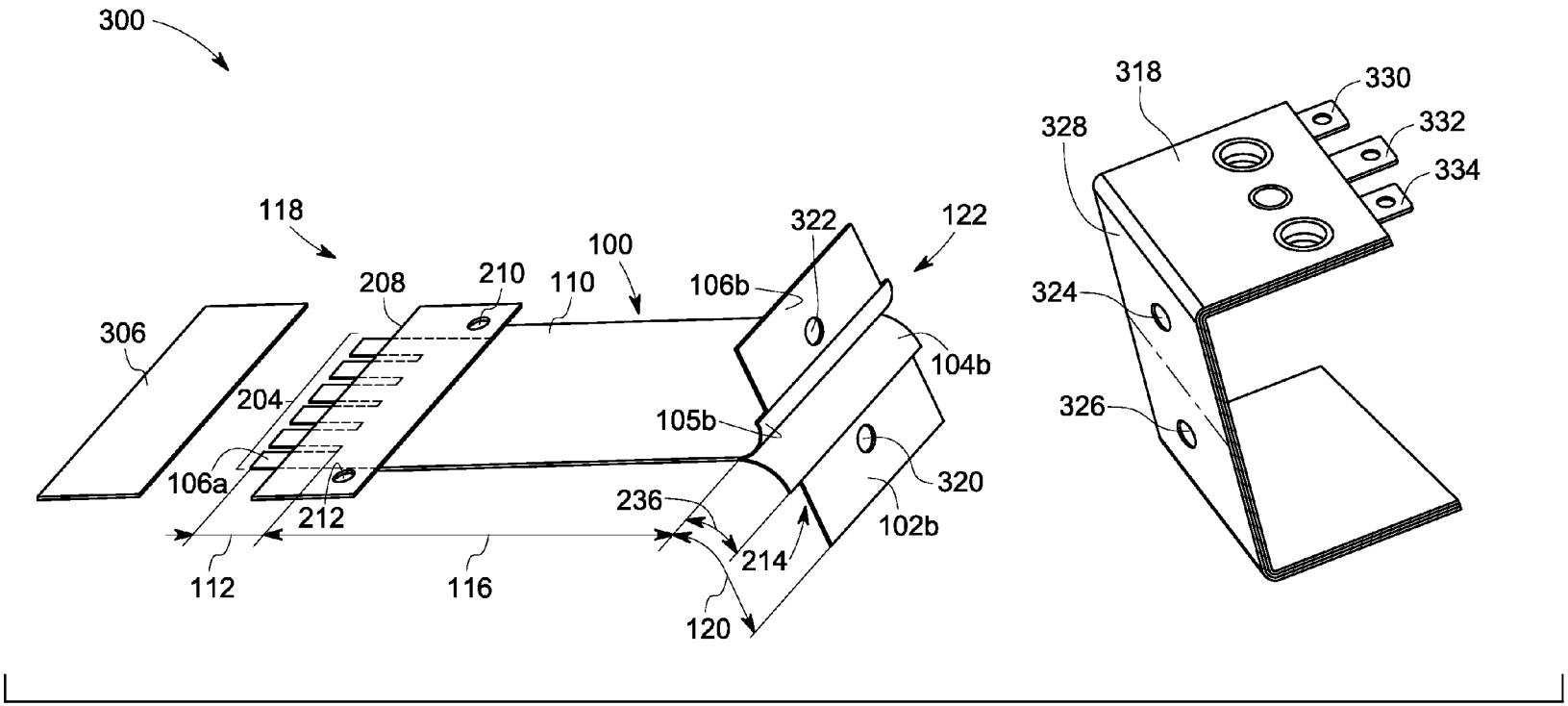
FIG. 3 is a perspective view of the power connector showing a top surface and protruding portions of the power connector of FIG. 1, in accordance with aspects of the present technique.

Turning now to FIG. 3, a diagrammatical illustration of a perspective view 300 of the power connector 100 is depicted. Particularly, FIG. 3 depicts a top surface and protruding portions of the power connector 100 of FIG. 1. It may be noted that the connector 100 in FIG. 3 is described with reference to FIGS. 1 and 2. As previously noted, the conducting strips 102, 106 protrude beyond the main body 116 of the stacked structure 101. More particularly, in the first portion 112 of the stacked structure 101, the first protruding conducting strip 102*a* is extended beyond the first peripheral layer 108, while the second protruding conducting strip 106*a* is extended beyond the second peripheral layer 110 and the insulating strips 104*a*, 105*a*. Furthermore, the tap structure 216 (see FIG. 2) of the first protruding conducting strip 102*a* and the tap structure 204 (see FIG. 2) of the second protruding conducting strip 106*a* in the first portion 112 are employed to electrically couple the connector 100 to a first conducting unit 306. The first conducting unit 306 may be any electrical circuit, bus bar, or power module that consumes power. In the embodiment illustrated in FIG. 3, the first conducting unit 306 may be a power module.

As will be appreciated, in a conventional power connector, the male component mates with the female component with an inherent air gap between the poles of the male component. Since there is an inherent air gap between the components, the components are loosely connected to each other with very large contact resistance in the connector, which further results in resistive losses in the connector. These shortcomings of the currently available connectors may be circumvented via use of the exemplary connector 100. Particularly, in accordance with aspects of the present technique, the tap structures 204, 216 are electrically coupled to the first conducting unit 306. More specifically, the first protruding conducting strips 102*a*, 106*a* are soldered to a substrate (not shown in FIG. 3) of the first conducting unit 306. For example, the tap structures 216 and 204 are employed to couple the connector 100 to the first conducting unit 306. By soldering the first protruding conducting strips 102*a*, 106*a* to the first conducting unit 306, the contact resistance is minimized, which further reduces resistive losses in the connector 100.

Additionally, as previously noted with respect to FIG. 2, the connector 100 includes strain relief apertures 210, 212 at the first end 118 of the stacked structure 101. The strain relief apertures 210, 212 are used to mechanically fasten at least a portion of the stacked structure 101 to the first conducting unit 306. Particularly, the strain relief apertures 210, 212 are used to crimp the stacked structure 101 to the first conducting unit 306. By crimping the stacked structure 101 to the first conducting unit 306, the connector 100 may be configured to withstand vibrations and/or other physical strains that occur at the first conducting unit 306 and/or at the connector 100.

With continuing reference to FIG. 3, the second portion 120 of the stacked structure 101 protrudes beyond the peripheral layers 108, 110 to aid in electrically coupling the connector 100 to a second conducting unit 318 at the second end 122 of the stacked structure 101. Further, as previously noted, the protruding second portion 120 of the stacked structure 101 includes the second set of protruding conducting strips 102*b*, 106*b* that are bent away from each other to form the curved section 124, (see FIG. 1), thereby preventing the protruding conducting strips 102*b*, 106*b* from contacting one another. This bent away or curved section 124 of the stacked structure 101 at the second end 122 is employed to couple the connector 100 to the second conducting unit 318.

In accordance with aspects of the present technique, the second conducting unit 318 includes a flat mating surface 328 that is disposed at a plane parallel to a plane of the bent conducting strips 102*b*, 106*b*. In certain embodiments, the conducting strips 102*b*, 106*b* include bolting apertures 320 and 322 respectively. Also, the mating surface 328 of the second conducting unit 318 includes apertures 324, 326 that may be aligned with respective bolting apertures 322, 320 of the conducting strips 106*b*, 102*b*, as depicted in FIG. 3.

In one embodiment, the apertures 324, 326 of the second conducting unit 318 may be used to face bolt the stacked structure 101 to the mating surface 328 of the second conducting unit 318. More specifically, the curved section 124 of the conducting strips 102*b*, 106*b* may be face bolted or otherwise coupled to respective terminals of the second conducting unit 318 by using the bolting apertures 320, 322. In one example, a bolt may be inserted through the bolting aperture 320 in the protruding conducting strip 102*b* and through a corresponding aperture 326 on the mating surface 328 of the second conducting unit 318. The bolt may be tightened using a nut, for example. Similarly, another bolt may be inserted through the bolting aperture 322 and through a corresponding aperture 324 on the mating surface 328 of the second conducting unit 318. The bolt may be tightened using a nut, for example. It may be noted that the second conducting unit 318, specifically the mating surface 328, may have two or more apertures that are used to couple one or more power connectors to the second conducting unit 318, and will be explained in greater detail with reference to FIG. 7. The second conducting unit 318 may be any electrical circuit, bus bar, or power module that consumes power. In the embodiment illustrated in FIG. 3, the second conducting unit 318 includes terminals 330, 332, 334 that may be connected to a power supply unit (not shown in FIG. 3) to provide power supply to the first conducting unit 306 via the connector 100.

Thus, by face bolting the conducting strips 102, 106 and more particularly the protruding conducting strips 102*b*, 106*b* to the second conducting unit 318, the contact resistance between the conducting strips 102, 106 and the second conducting unit 318 is substantially reduced, which in return minimizes the resistive losses in the connector 100. Also, since the conducting strips 102, 106 are mechanically fastened to the second conducting unit 318, the connector 100 is configured to withstand vibrations and/or other physical strains that may occur at the second conducting unit 318 and/or at the connector 100.

Furthermore, as previously noted, the second set of protruding insulating strips 104*b*, 105*b* are interposed between the second set of protruding conducting strips 102*b*, 106*b*. Also, the second set of protruding insulating strips 104*b*, 105*b* are configured to insulate at least a portion 236 of the second set of protruding conducting strips 102*b*, 106*b* that is not electrically coupled to the second conducting unit 318. In one example, the protruding insulating strip 104*b* insulates or covers a portion 236 of the protruding conducting strip 102*b* in the curved section 124. Similarly, the protruding insulating strip 105*b* insulates or covers a portion 236 of the protruding conducting strip 106*b* in the curved section 124. In one embodiment, the curved section 124 of the second set of protruding conducting strips 102*b*, 106*b* may have a radius in a range from about 1 mm to about 10 mm As noted hereinabove, the conducting strips 102, 106 are positioned in close proximity to each other. Disposing the conducting strips 102, 106 in close proximity to each other advantageously minimizes the area of an inductive loop, which in turn reduces the inductive losses in the connector 100. In addition, since the connector 100 is soldered at the first end 118 to the first conducting unit 306 and face bolted at the second end 122 to the second conducting unit 318, the contact resistance between the connector 100 and the conducting units 306, 318 is substantially minimized, which in turn reduces resistive losses in the connector 100. Moreover, since the connector 100 is flexible, the connector 100 can be bent and used to connect the conducting units 306, 318 disposed at any position and/or location.

Figure 4:
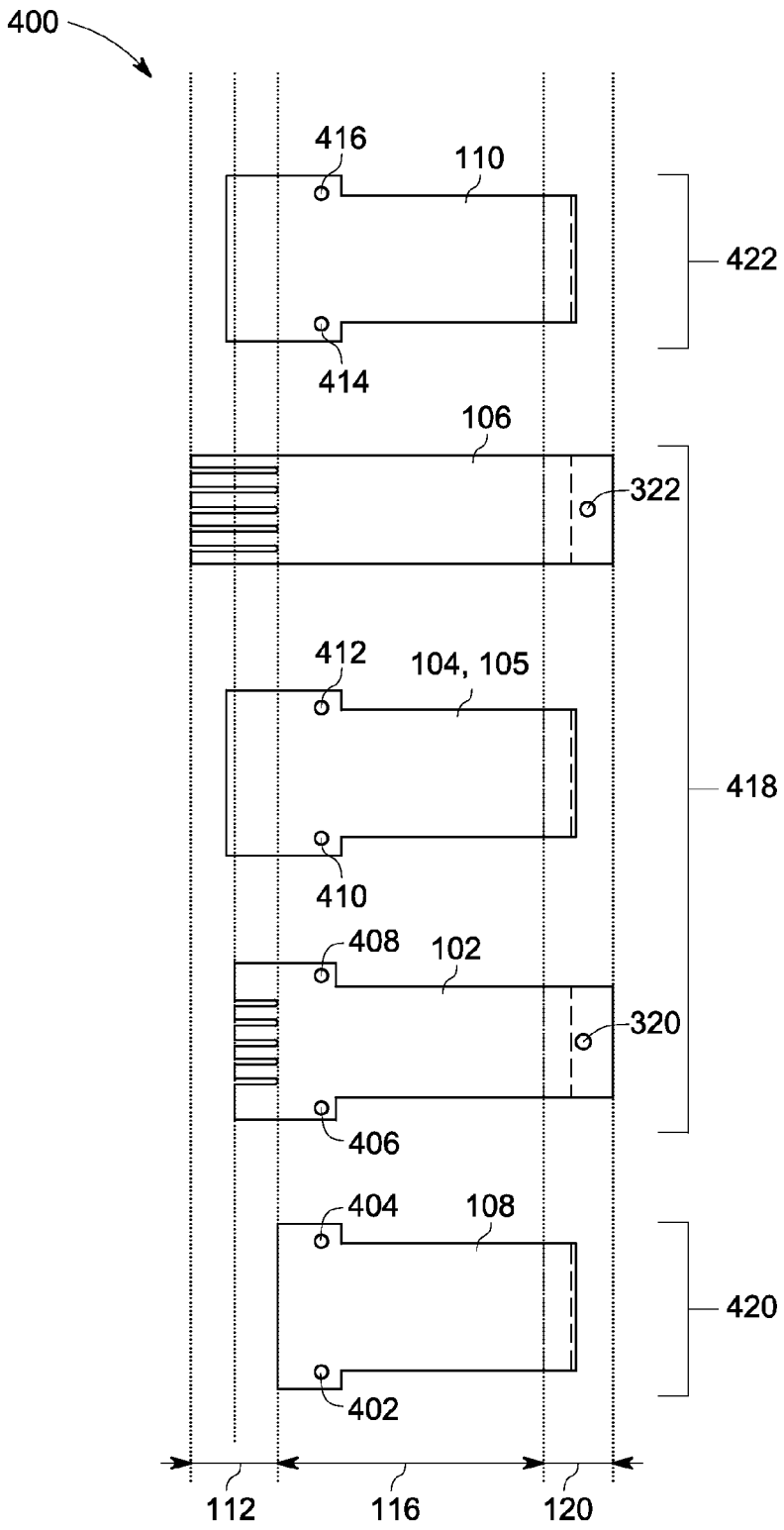
FIG. 4 is a diagrammatic representation of a method for forming the power connector of FIG. 1, in accordance with aspects of the present technique.

FIG. 4 is a diagrammatical representation 400 of a method for forming the power connector 100 of FIGS. 1-3. It may be noted that the method for forming the connector 100 of FIG. 4 is described with reference to FIGS. 1-3. The different layers of the stacked structure 101 are planar in structure and are disposed parallel and proximate to each other.

In accordance with aspects of the present technique, one or more layers of insulating strips may be alternatingly arranged with a plurality of layers of conducting strips to form the stacked structure 101, as depicted by step 418. Particularly, in one embodiment, the stacked structure 101 is formed by disposing a first conducting strip, such as the first conducting strip 102, as a bottom layer of the stacked structure 101. The first conducting strip 102 includes strain relief apertures 406, 408 that may subsequently be aligned with the strain relief apertures of other strips. The first conducting strip 102 may be formed using copper to aid in conducting power between the first and second conducting units 306, 318 (see FIG. 3).

Subsequently, one or more insulating strips, such as the insulating strips 104, 105 are disposed over the first conducting strip 102. The insulating strips 104, 105 may be formed using polyimide film. In one embodiment, if more than one insulating strip is employed, then the insulating strips may be joined together by placing an adhesive material between them. Particularly, the insulating strips 104, 105 are joined together at the first end 118 of the stacked structure 101. However, at the second end 122 of the stacked structure 101, and more specifically at the curved section 124 of the stacked structure 101 (see FIG. 3), the insulating strips 104, 105 are separated and bent away from each other. Also, the insulating strips 104, 105 include strain relief apertures 410, 412 that are respectively aligned with strain relief apertures 406, 408 of the first conducting strip 102 to facilitate crimping of the stacked structure 101 to the first conducting unit 306.

Moreover, a second conducting strip, such as the second conducting strip 106, is disposed over the insulating strips 104, 105. The second conducting strip 106 is substantially similar to the first conducting strip 102. However, in one embodiment, the second conducting strip 106 is formed without any strain relief apertures. The strain relief apertures are eliminated from the second conducting strip 106 to prevent any direct electrical contact with the first conducting strip 102, especially while crimping the stacked structure 101 with a metal nut or screw in the strain relief apertures. The second conducting strip 106 may be formed using copper to help in conducting power between the first and second conducting units 306, 318. The stacking of the first and second conducting strips 102, 106 and disposing the insulating strips 104, 105 therebetween result in the formation of the exemplary stacked structure 101.

Thereafter, the first peripheral layer 108 and the second peripheral layer 110 are disposed on a portion of the stacked structure 101, as indicated by steps 420 and 422. Particularly, the first peripheral layer 108 is disposed at the bottom of the stacked structure 101 to insulate the stacked structure 101 from any external conducting surfaces. More specifically, the first peripheral layer 108 is disposed on a portion of an outer surface of the first conducting strip 102 to insulate the first conducting strip 102 from any external conducting surfaces. Furthermore, the first peripheral layer 108 is disposed on the outer surface of the first conducting strip 102, such that a portion of the stacked structure 101 extends or protrudes beyond the first peripheral layer 108. In one embodiment, the first peripheral layer 108 may be a polyimide layer. The first peripheral layer 108 also includes strain relief apertures 402, 404 that are used to crimp the first peripheral layer 108 along with other layers in the stacked structure 101 to the first conducting unit 306.

In a similar manner, the second peripheral layer 110 is disposed on a portion of a top surface of the second conducting strip 106, for example. Particularly, the second peripheral layer 108 is disposed on the outer surface of the second conducting strip 106, such that a portion of the stacked structure 101 extends or protrudes beyond the second peripheral layer 110. The second peripheral layer 110 insulates the second conducting strip 106 from any external conducting surfaces disposed proximate to the stacked structure 101. The second peripheral layer 110 also includes strain relief apertures 414, 416 using which the stacked structure 101 is crimped to the first conducting unit 306.

Additionally, the first and second peripheral layers 108, 110 are disposed on the stacked structure 101 in such a way that the first conducting strip 102 protrudes beyond the first peripheral layer 108, while the second conducting strip 106 protrudes beyond the second peripheral layer 110. In addition, the insulating strips 104, 105 may be protruded beyond the first conducting strip 102 but within the second conducting strip 106, as depicted in FIG. 4. Further, the protruding first portion 112 of the stacked structure 101 is configured to aid in coupling the conducting strips 102, 106 to corresponding terminals on the first conducting unit 306. In certain embodiments, the protruding first portion 112 of the stacked structure 101 is etched to form a tap structure, such as the tap structures 204, 216. The tap structures 204, 216 aid in coupling the connector 100 to the first conducting unit 306.

Similarly, at the second end 122, the second protruding portion 120 of the stacked structure 101 includes the conducting strips 102, 106 and the insulating strips 104, 105 that extend or protrude beyond the first peripheral and second peripheral layers 108, 110. Particularly, at the second end 122, the conducting strips 102, 106 are bent away from each other to aid in face bolting each of the conducting strips 102, 106 to respective terminals in the second conducting unit 318. More specifically, the second portion 120 of the stacked structure 101 includes apertures, such as the bolting apertures 320, 322, that aid in face bolting the connector 100 to the second conducting unit 318. In one embodiment, the second conducting unit 318 may include bus bars with apertures such as the apertures 324, 326 to face bolt the second conducting unit 318 to the conducting strips 102, 106 in the stacked structure 101.

Furthermore, the stacked structure 101 may have a length in a range from about 35 mm to about 100 mm and a width in a range from about 25 mm to about 55 mm, in certain embodiments. Also, the stacked structure 101 may have a thickness in a range from about 0.25 mm to about 3 mm, in one embodiment. In addition, the conducting strips 102, 106 in the stacked structure 101 are separated by a distance in a range from about 0.01 mm to about 0.2 mm, for example. Consequent to arranging the stacked structure 101 as described hereinabove, the width of the stacked structure 101 is substantially increased relative to the distance between the conducting strips 102, 106 of the stacked structure 101. This increase in the width of the stacked structure 101 relative to the distance between the conducting strips 102, 106 advantageously minimizes the inductance in the stacked structure 101.

Figure 5:
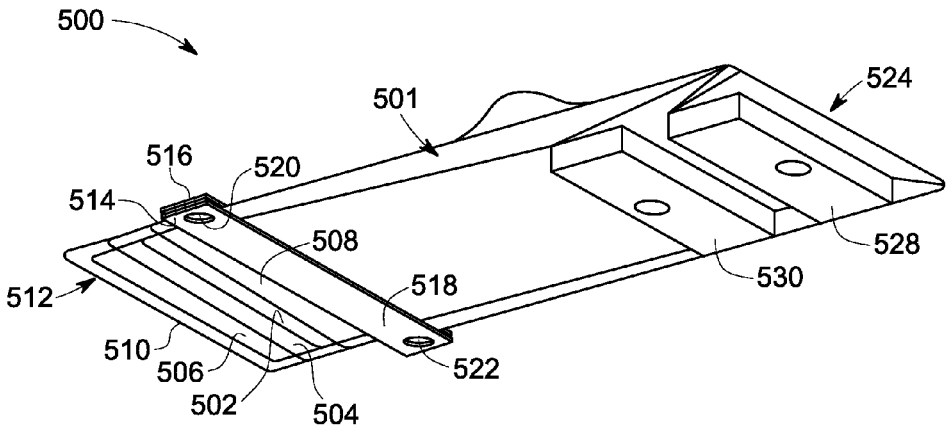
FIG. 5 is a perspective view of another embodiment of a power connector, in accordance with aspects of the present technique.
Figure 6:
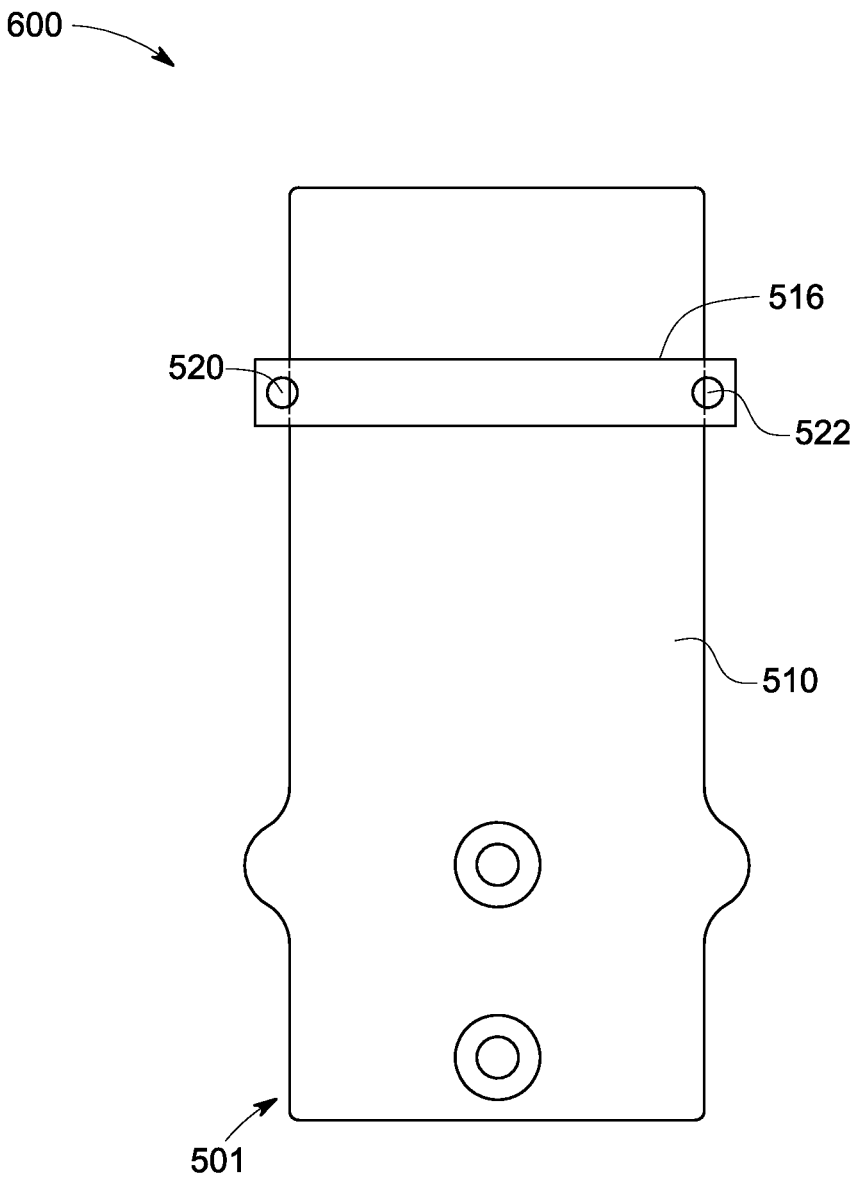
FIG. 6 is a top view of the power connector of FIG. 5, in accordance with aspects of the present technique.

FIG. 5 is a perspective view 500 of another embodiment of a power connector 501, in accordance with aspects of the present technique, while FIG. 6 is a top view 600 of the power connector 501 of FIG. 5. The power connector 501 includes a plurality of layers of conducting strips arranged with alternating layers of insulating strips to form the stacked structure. In the example depicted in FIG. 5, conducting strips 502, 506 are planar conductors which are disposed in close proximity to each other with a thin insulator, such as an insulating strip 504 disposed between the conducting strips 502, 506.

In addition, the power connector 501 includes at least one peripheral layer that is disposed on at least a portion of the stacked structure. Particularly, the power connector 501 includes a first peripheral layer 508 that is disposed on a portion of a bottom surface of the stacked structure to prevent or insulate the first conducting strip 502 from any external conducting surfaces and/or materials. Similarly, the power connector 501 includes a second peripheral layer 510 that is disposed on a portion of a top surface of the stacked structure to insulate the second conducting strip 506 from any external conducting surfaces and/or materials.

Further, the conducting strips 502, 506 at a first end 512 of the stacked structure may be coupled to a first conducting unit, such as the first conducting unit 306 of FIG. 3. Particularly, in accordance with exemplary aspects of the present technique, the conducting strips 502, 506 are arranged in a step structure, where the insulating strip 504 protrudes beyond the first conducting strip 502 and the second conducting strip 506 protrudes beyond the insulating strip 504. This kind of step arrangement aids in separating the first conducting strip 502 and the second conducting strip 506, especially while soldering the conducting strips 502, 506 to the first conducting unit 306.

With continuing reference to FIG. 5, the connector 501 further includes one or more strain relief bars 514. These strain relief bars 514 enable the flexible power connector 501 to withstand vibrations and other strains. In certain embodiments, the strain relief bar 514 includes at least two bars, wherein the first strain relief bar 516 is disposed on a top surface of the power connector 501, and a second strain relief bar 518 is disposed on a bottom surface of the power connector 501, as depicted in FIGS. 5 and 6. The first strain relief bar 516 and the second strain relief bar 518 are disposed parallel to each other, thereby allowing the two strain relief bars 516, 518 to be coupled by inserting a screw or a nut through strain apertures 520 and 522 in the bars 516, 518. For example, a bolt may be inserted through the strain aperture 520 of the bars 516, 518 and the bolt may be tightened by using a nut, for example. Similarly, the other end of the bars 516, 518 are also tightened by inserting another bolt in the strain aperture 522 of the bars 516, 518 and the bolt may be tightened by using a nut, for example.

Additionally, at a second end 524 of the stacked structure 501, the power connector 501 may also include one or more shims coupled to corresponding conducting strips. Particularly, in one embodiment, the connector 501 includes a first shim 528 and a second shim 530. The first shim 528 is coupled to the first conducting strip 502 and insulated from the second conducting strip 506. Similarly, the second shim 530 is coupled to the second conducting strip 506 and insulated from the first conducting strip 502. The coupling of the shims 528, 530 to their respective conducting strips 502, 506 are depicted in the FIGS. 5 and 6.

Moreover, the first shim 528 and the second shim 530 are configured to aid in face bolting their corresponding conducting strips 502, 506 to a second conducting unit, such as the second conducting unit 318 of FIG. 3. The second conducting unit 318 may be a bus bar, power module, or any other electrical circuit that consumes power. In one example, the shims 528 and 530 may be copper berilium shims that are bolted to the bus bar. Also, in one embodiment, the stacked structure may be flexible. This flexibility of the stacked structure of the connector 501 allows bending of the connector 501 upwards or downwards to face bolt the shims 528, 530 to the second conducting unit 318.

Figure 7:
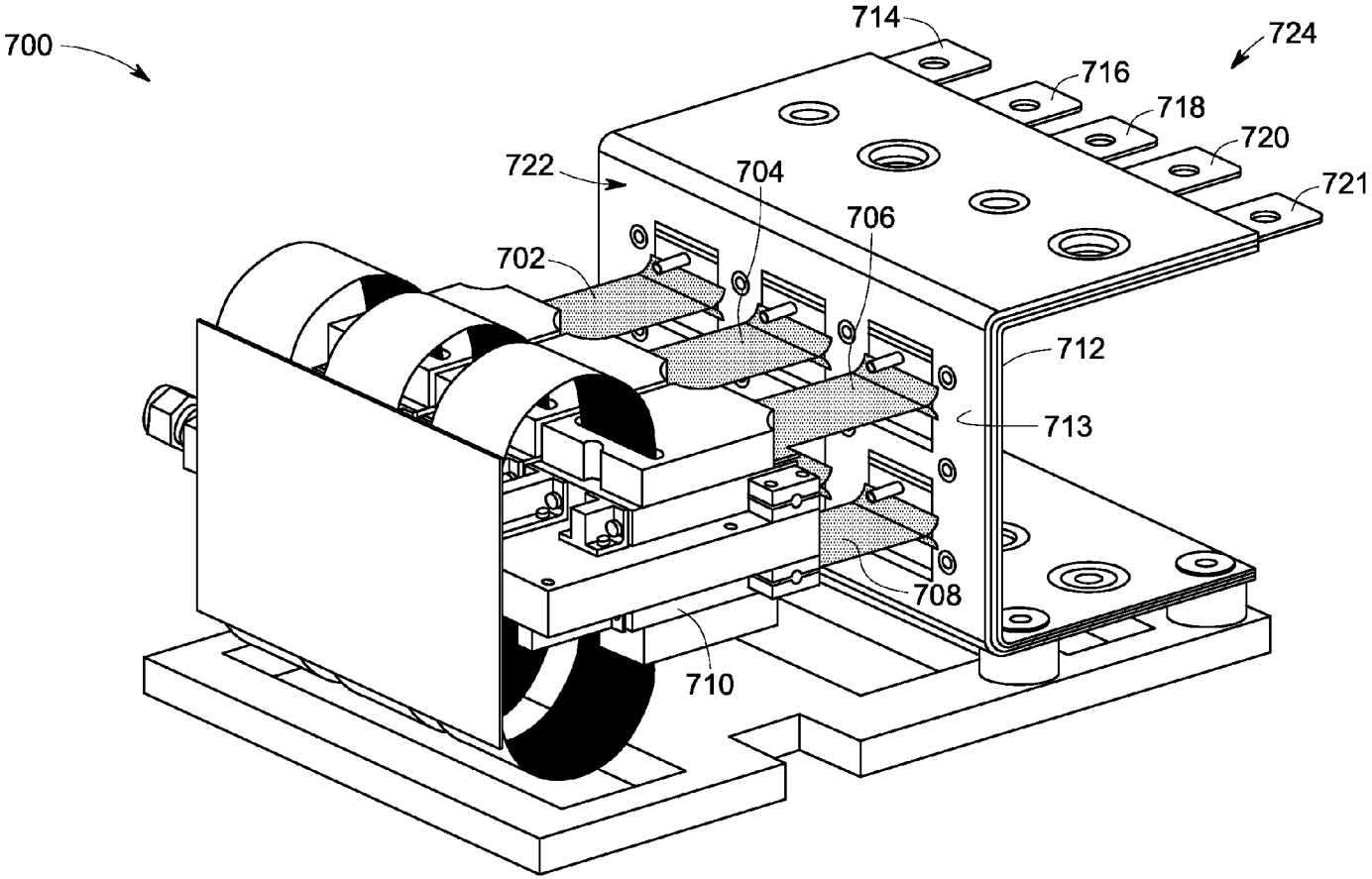
FIG. 7 is a perspective view of the power connector of FIG. 1 coupled between a first conducting unit and a second conducting unit, in accordance with aspects of the present technique.

Referring to FIG. 7, a perspective view 700 of the power connectors of FIG. 1 coupled between power module 710 and bus bar 712, in accordance with aspects of the present technique is depicted. It may be noted that the power module 710 may include one or more first conducting units 306 of FIG. 3, while the bus bar 712 may include one or more second conducting units 318 of FIG. 3. Particularly, FIG. 7 depicts a plurality of power connectors 702, 704, 706, 708 employed to couple the power module 710 and the bus bar 712. Each of the power connectors 702, 704, 706, 708 may be representative of the power connector 100 of FIG. 3.

In accordance with aspects of the present technique, the bus bar 712 include multiple layers with a mating surface 713 at a first end 722 of the bus bar 712. The mating surface 713 is disposed substantially parallel to bent conducting strips, such as the conducting strips 102*b*, 106*b* of each of the power connectors 702, 704, 706, 708. Further, the mating surface 713 is employed to face bolt each of the power connectors 702, 704, 706, 708 to the bus bar 712, as depicted in FIG. 7. In addition, the bus bar 712 include one or more terminals 714, 716, 718, 720, 721 at a second end 724 of the bus bar 712 that are employed to couple the bus bar 712 to a power supply unit (not shown in FIG. 7). Furthermore, at a first end, such as the first end 118, each of the power connectors 702, 704, 706, 708 is coupled to their respective power module 710, as depicted in FIG. 7. Accordingly, the power connectors 702, 704, 706, 708 may be employed to couple the power module 710 to the bus bar 712.

The power connectors and the method of forming the power connector described hereinabove aid in reducing the electrical losses in the connector. Also, the flexible nature of power connector allows manipulation of the connector to any shape, which further aids in coupling conducting units placed in any position and/or location. In addition, since the stacked arrangement of conducting strips substantially reduces the inductive loop in the connector, the connector is capable of operating with high current power modules at high switching frequencies. Moreover, the power connector described hereinabove is a low cost, rugged and cost affective single component connector, as opposed to the currently available expensive two-component connector. Further, since the power connector employs planar conducting strips, parasitic inductance in the connector may be substantially minimized Additionally, use of the planar low inductance strips substantially reduces the cost and complexity of the power connector. Also, such a power connector can be fabricated using a low cost batch process.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A flexible power connector, comprising:

a stacked structure having one or more insulating strips alternatingly arranged with a plurality of conducting strips, wherein the one or more insulating strips are interposed between the plurality of conducting strips to insulate each conducting strip from the other conducting strip in the stacked structure, and wherein the plurality of conducting strips is disposed parallel and proximate to each other to reduce electrical losses in the stacked structure; and at least one peripheral insulating layer disposed on a portion of the stacked structure and configured to insulate the stacked structure from an external conducting material, wherein a first portion of the stacked structure at a first end having the conducting strips and the insulating strips protrude beyond the at least one peripheral insulating layer, and wherein the protruding first portion is configured to electrically couple the conducting strips to a first conducting unit.

2. The flexible power connector of claim 1, wherein the plurality of conducting strips is disposed proximate to each other to minimize separation between the conducting strips relative to a width of each conducting strip.

3. The flexible power connector of claim 1, wherein the plurality of conducting strips at the first end of the stacked structure is coupled to the first conducting unit and the plurality of conducting strips at a second end of the stacked structure is coupled to a second conducting unit.

4. The flexible power connector of claim 3, wherein the plurality of conducting strips in the first portion of the stacked structure is soldered to the first conducting unit.

5. The flexible power connector of claim 4, wherein at least one of the conducting strips in the first portion of the stacked structure protrudes beyond the other conducting strips.

6. The flexible power connector of claim 4, further comprising at least one aperture at the first end of the stacked structure, wherein the at least one aperture is configured to allow crimping the first end of the stacked structure to the first conducting unit.

7. The flexible power connector of claim 4, further comprising at least one strain relief bar coupled to the first end of stacked structure and configured to fasten the first end of the stacked structure to the first conducting unit.

8. The flexible power connector of claim 3, wherein a second portion of the stacked structure at the second end having the conducting strips and the insulating strips protrude beyond the at least one peripheral insulating layer, and wherein the protruding second portion is configured to electrically couple the conducting strips to the second conducting unit.

9. The flexible power connector of claim 8, wherein the conducting strips in the second portion of the stacked structure are bent away from each other to aid in face bolting the conducting strips to the second conducting unit.

10. The flexible power connector of claim 9, wherein the one or more insulating strips in the second portion of the stacked structure are interposed between the plurality of conducting strips and configured to insulate at least a portion of the conducting strips.

11. The flexible power connector of claim 8, further comprising at least one conducting shim coupled to each conducting strip at the second end of the stacked structure and configured to aid in face bolting each conducting strip to the second conducting unit.

12. A method for forming a power connector, the method comprising:

alternatingly disposing one or more insulating strips between a plurality of conducting strips to form a stacked structure, wherein the plurality of conducting strips are disposed parallel and proximate to each other; and disposing at least one peripheral insulating layer on a portion of the stacked structure such that a first portion of the stacked structure at a first end of the stacked structure having the conducting strips and the insulating strips protrude beyond the at least one peripheral layer and a second portion of the stacked structure at a second end of the stacked structure having the conducting strips and the insulating strips protrude beyond the at least one peripheral layer.

13. The method of claim 12, further comprising crimping at least a portion of the stacked structure at the first end to the first conducting unit.

14. The method of claim 12, wherein the first portion of the stacked structure is configured to couple the conducting strips at the first end of the stacked structure to a first conducting unit, and the second portion of the stacked structure is configured to electrically couple the conducting strips at the second end of the stacked structure to a second conducting unit.

15. The method of claim 14, further comprising bending the conducting strips in the second portion of the stacked structure away from each other, wherein the bent conducting strips are configured to aid in face bolting the conducting strips to the second conducting unit.

16. The method of claim 12, further comprising disposing the plurality of layers of conducting strips proximate to one another to minimize inductance in the stacked structure.

17. The method of claim 12, further comprising coupling at least one conducting shim to one of the conducting strips, wherein the at least one conducting shim is configured to aid in face bolting one of the conducting strips to the second conducting unit.

18. A system, comprising:

one or more flexible power connectors, wherein each of the one or more flexible power connectors comprises:

a stacked structure having one or more insulating strips alternatingly arranged with a plurality of conducting strips, wherein the one or more insulating strips are interposed between the plurality of conducting strips to insulate each conducting strip from the other conducting strip in the stacked structure, and wherein the plurality of conducting strips is disposed parallel and proximate to each other;

at least one peripheral insulating layer disposed on a portion of the stacked structure such that at least a portion of the stacked structure protrudes beyond the at least one peripheral layer at the first end and the second end of the stacked structure, wherein the at least one peripheral layer is configured to insulate the stacked conducting layers from at least one external conducting material;

a first conducting unit coupled to a first end of the one or more flexible power connectors; and a second conducting unit coupled to a second end of the one or more flexible power connectors.

* * * * *